US007031489B2

(12) United States Patent
Amino

(10) Patent No.: US 7,031,489 B2
(45) Date of Patent: Apr. 18, 2006

(54) MAGNETIC CIRCUIT FOR SPEAKER WITH SHORT-CIRCUITING RING

(75) Inventor: Kenta Amino, Tamaho-machi (JP)

(73) Assignee: Minebea Co., Ltd., Nagano-ken (JP)

( * ) Notice: Subject to any disclaimer, the term of this patent is extended or adjusted under 35 U.S.C. 154(b) by 0 days.

(21) Appl. No.: 10/447,224

(22) Filed: May 29, 2003

(65) Prior Publication Data

US 2004/0042631 A1 Mar. 4, 2004

(30) Foreign Application Priority Data

Aug. 28, 2002 (JP) ..... 2002-248841

(51) Int. Cl.
*H04R 25/00* (2006.01)

(52) U.S. Cl. ..... 381/414; 381/412; 381/420

(58) Field of Classification Search ..... 381/396, 381/397, 412, 414, 419–420, 400–402
See application file for complete search history.

(56) References Cited

U.S. PATENT DOCUMENTS

| | | | | |
|---|---|---|---|---|
| 3,803,522 | A * | 4/1974 | Rooney | 335/231 |
| 3,881,074 | A * | 4/1975 | Kawamura | 381/414 |
| 5,583,945 | A * | 12/1996 | Iijima et al. | 381/412 |
| 6,088,466 | A * | 7/2000 | Proni | 381/397 |
| 6,639,993 | B1 * | 10/2003 | Kemmerer et al. | 381/397 |
| 6,768,806 | B1 * | 7/2004 | Button et al. | 381/401 |
| 6,847,726 | B1 * | 1/2005 | Button et al. | 381/401 |
| 2003/0123694 | A1 * | 7/2003 | Kemmerer et al. | 381/412 |
| 2003/0190052 | A1 * | 10/2003 | Button et al. | 381/401 |
| 2004/0005075 | A1 * | 1/2004 | Kobayashi et al. | 381/414 |
| 2004/0042631 | A1 * | 3/2004 | Amino | 381/412 |
| 2004/0239193 | A1 * | 12/2004 | Moro et al. | 310/12 |

FOREIGN PATENT DOCUMENTS

| | | |
|---|---|---|
| JP | 58-38099 | 3/1983 |
| JP | 58-206298 | 12/1983 |
| JP | 63-29358 | 8/1988 |
| JP | 03-201797 | 9/1991 |
| JP | 7-32514 | 4/1995 |
| JP | 07-170597 | 7/1995 |
| JP | 2737273 | 1/1998 |
| JP | 2586414 | 10/1998 |

* cited by examiner

*Primary Examiner*—Sinh Tran
*Assistant Examiner*—Phylesha Dabney
(74) *Attorney, Agent, or Firm*—McDermott Will & Emery LLP

(57) ABSTRACT

A magnetic circuit for a speaker comprises: a bottom yoke including a center pole; a ring magnet; a top plate; and a short-circuiting ring shaped like a hollow cylinder. The short-circuiting ring is disposed close and parallel to a voice coil and attached to the inner portion of the bottom of the top plate.

4 Claims, 6 Drawing Sheets

MAGNETIC CIRCUIT FOR SPEAKER WITH SHORT-CIRCUITING RING

BACKGROUND OF THE INVENTION

1. Field of the Invention

The present invention relates to a magnetic circuit for a speaker, especially a cone speaker for use in various audio equipments.

2. Description of the Related Art

It is well known that in a cone speaker, a current strain, which is attributable to a change in the position of a voice coil relative to a gap incurred by a large amplitude of bass, or attributable to a magnetic material forming a magnetic circuit, is conventionally addressed, for example, such that a short-circuiting ring made of copper or aluminum is put inside a pole piece or magnet and shorted thereby reducing an inductance of the voice coil closer to zero.

A short-circuiting ring disclosed in Japanese Patent No. 2737273 is made of a copper plate, formed into a cylinder, and attached to a center pole so as to be concentric with and parallel to a voice coil. The short-circuiting ring is adapted to short an eddy current flowing in the center pole with a voice current flowing in the voice coil thereby increasing the sound pressure level in a high frequency region.

Another short-circuiting ring is disclosed in Japanese Utility Model Publication No. Sho 63-29358, which has a slit formed in a longitudinal direction and is attached to a center pole, and still another short-circuiting ring is disclosed in Japanese Utility Model No. 2586414, which is composed of a meshwork comprising a plurality of electrically conductive thin wires meshed in a cylindrical form so as to be extendable, and which is attached to the side of the center pole except a gap portion.

In the above conventional measures, in which the short-circuiting ring as the secondary winding of the voice coil is shorted thereby reducing the inductance of the voice coil, and is disposed outside the center pole or inside the magnet thereby holding down a second harmonic distortion, the gap may possibly be expanded thereby reducing the magnetic flux density, and also the short-circuiting ring attached near the magnet has little influence on an impedance in a high-frequency region thus not promising much effect.

Under the above circumstances, a speaker is disclosed in Japanese Patent Publication No. Hei 7-32514, in which no short-circuiting ring is used, and a magnet for a magnetic circuit is formed of an electrically conductive ferrite containing divalent iron. This, however, invites an increase in magnet cost, raising problems with practical use.

SUMMARY OF THE INVENTION

The present invention has been made in view of the above, and it is an object of the present invention to provide a magnetic circuit for a speaker, in which a short-circuiting ring is provided near a voice coil thereby cutting off an AC magnetic field generated by the vibration of a voice coil so as to counteract an impedance in a high-frequency region to maintain sound pressure level.

In order to achieve the above object, according to a first aspect of the present invention, a magnetic circuit for a speaker comprises: a bottom yoke having a center pole; a ring magnet; a top plate; and a cylindrical short-circuiting ring. The short-circuiting ring is disposed close and parallel to and naturally concentric with a voice coil, and attached to the inner portion of the bottom of the top plate.

According to a second aspect of the present invention, in the magnetic circuit for a speaker of the first aspect, the short-circuiting ring has a height equal to or larger than the excursion (moving distance from the original position) of the voice coil.

According to a third aspect of the present invention, in the magnetic circuit for a speaker of the first aspect, the short-circuiting ring has a height equal to the distance from the bottom of the top plate to the top of the central portion of the bottom yoke.

According to a fourth aspect of the present invention, in the magnetic circuit for a speaker of any one of the first to fourth aspects, the short-circuiting ring is made of aluminum or copper.

Due to the location of the short-circuiting ring, the AC magnetic field generated by the voice coil moving up and down can be effectively blocked off thereby reducing significantly the current distortion, and also the short-circuiting ring does not give any restriction to the magnetic gap, does not interferes with the movement of the voice coil, and can be attached simply and easily. Further, due to the length of the short-circuiting ring, the center pole has its circumference surface mostly covered, whereby the AC magnetic field beyond the excursion of the voice coil can be blocked off, the output sound pressure level in a high-frequency region can be increased, and at the same time the total harmonic distortion can be effectively suppressed.

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION OF THE PREFERRED EMBODIMENTS

Embodiments of the present invention will hereinafter be described with reference to the accompanying drawings.

Figure 1:
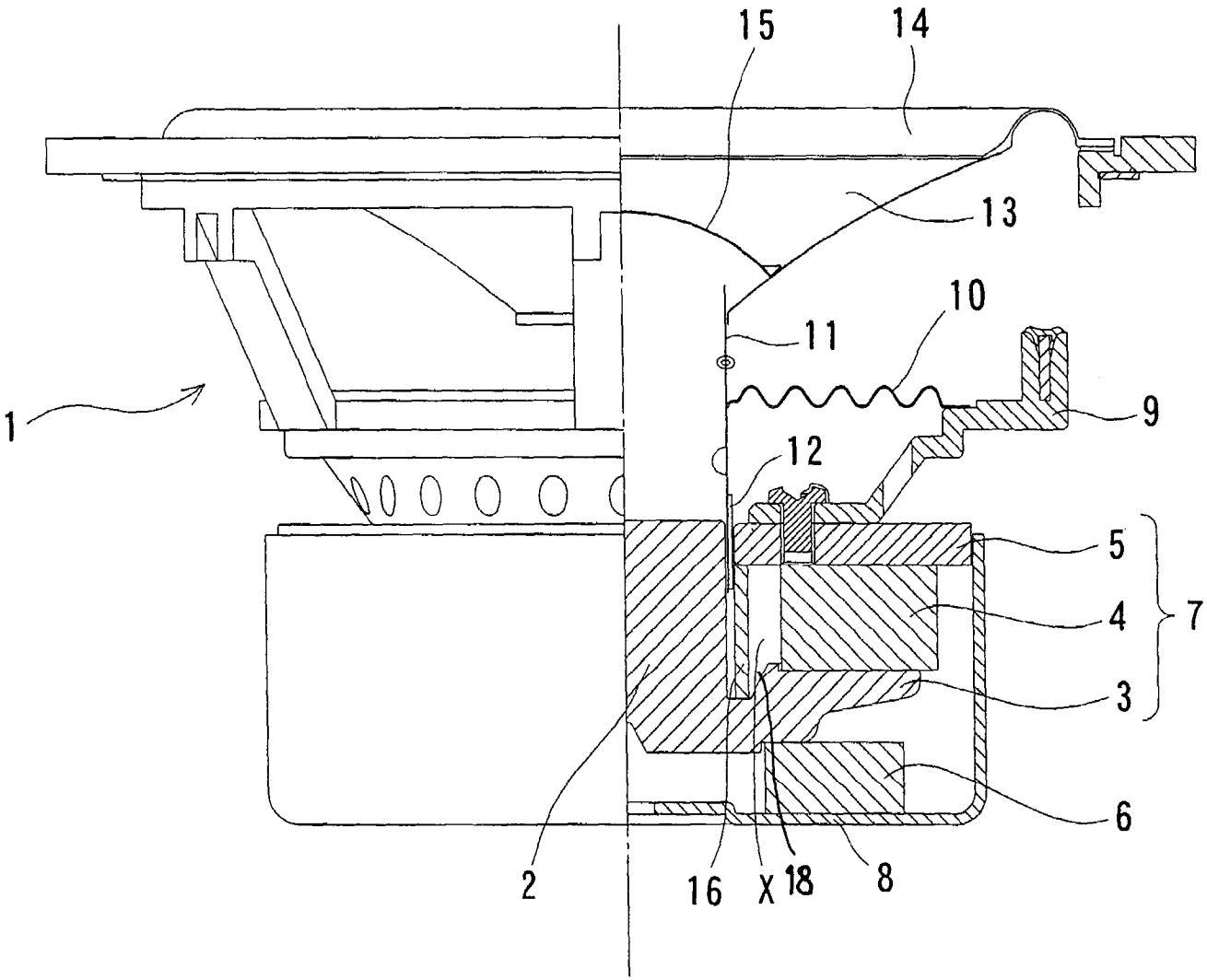
FIG. 1 is a partly cross-sectioned side view of a speaker using a magnetic circuit according to one embodiment of the present invention.

Referring to FIG. 1, a speaker 1 comprises: a magnetic circuit 7 which includes a bottom yoke 3 having a center pole 2 disposed at its central portion, a ring magnet 4 fixed onto the outer portion of the top face of the bottom yoke 3, and a top plate 5 fixed onto the top face of the magnet 4; a frame 9 fixed by screws onto the top face of the top plate 5; a spider 10 having its outer circumference fixed onto the lower part (toward the bottom) of the frame 9; a voice coil bobbin 11 suspended by the spider 10; a voice coil 12 wound around the voice coil bobbin 11 and movably disposed in a gap of the magnetic circuit 7; a cone diaphragm 13 fixed onto the upper part (toward the open top) of the frame 9 via a surround 14; and a dust cap 15 disposed over the voice coil bobbin 11. The speaker 1 further includes: a cancel magnet 6 magnetized in a direction opposite to the magnet 4, disposed on the bottom face of the bottom yoke 3, and adapted to improve magnetic flux of the gap; and a yoke cover 8 adapted to prevent leakage flux from the magnetic circuit 7.

In the speaker 1 described above, the magnetic circuit 7 further includes a short-circuiting ring 16 which is electrically conductive, has a height equal to or larger than the excursion of the voice coil 12, and which is disposed in an open space X defined by the lower face of the top plate 5, the inner circumferential face of the magnet 4, and the upper face of the bottom yoke 3. Specifically, the short-circuiting ring 16 is a hollow cylinder formed of aluminum, has a height substantially equal to the distance from the bottom face of the top plate 5 to the central portion of the top face of the bottom plate 3, has an inner diameter slightly larger than the outer diameter of the voice coil 12 so as to have its inner face located as close to the voice coil 12 as possible, and is disposed parallel to and naturally concentric with the voice coil 12.

Figure 2:
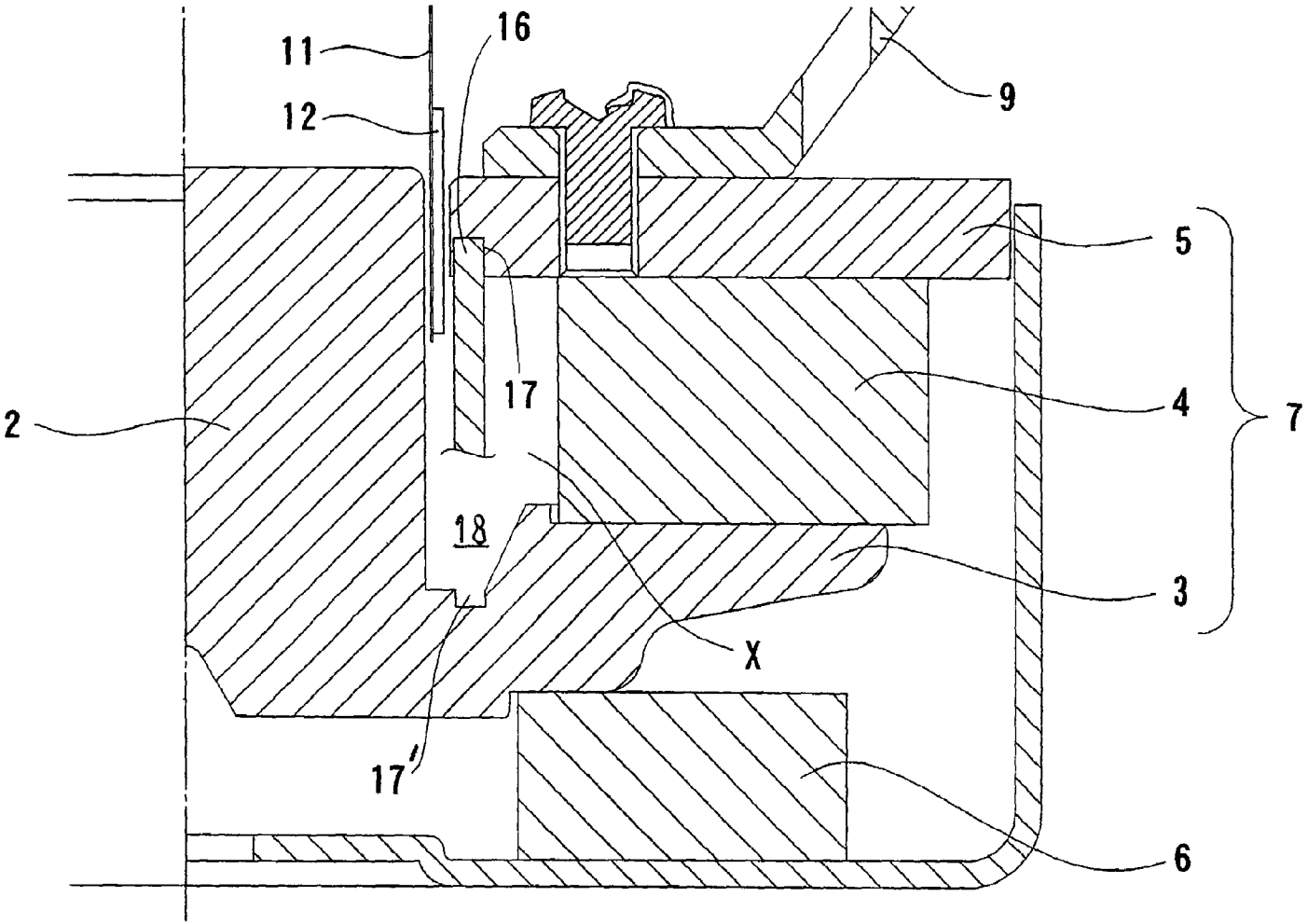
FIG. 2 is an enlarged cross-sectional side view of a magnetic circuit according to another embodiment of the present invention.

The short-circuiting ring 16 can be fixed to the magnetic circuit 7, for example, such that the upper and lower ends of the short-circuiting ring 16 are provided with adhesive and attached to respective prescribed portions of the bottom face of the top plate 5 and the top face of the bottom yoke 3. As seen in FIG. 1, the top face of the bottom yoke 3 is in cylindrical depression 18. Alternatively, the short-circuiting ring can be fixed such that the upper and lower ends of the short-circuiting ring 16 with an increased height are fitted respectively into a groove 17 and a groove 17' (see FIG. 2), extending in a circle to correspond to the short-circuiting ring 16 and located at the respective prescribed portions of the bottom face of the top plate 5 and the top face of the bottom yoke 3. As seen in FIG. 2, the top face of the bottom yoke, in which the groove 17' is located, is in cylindrical depression 18 also.

Conventionally, when a voice current flows in the voice coil causing the voice coil to vibrate moving up and down like a piston, magnetic flux is caused to flow through the center pole and the top plate disposed near the voice coil thereby generally increasing a third harmonic distortion, and magnetic flux flowing through the magnet is caused to increase thereby increasing a second harmonic distortion. On the other hand, in the speaker 1 using the magnetic circuit 7 of the present invention described above, since the short-circuiting ring 16, which is electrically conductive and has the height equal to or larger than the excursion of the voice coil 12, is attached to the bottom face of the top plate 5 so as to be disposed close and parallel to and naturally concentric with the voice coil 12, an AC magnetic field generated by the vibration of the voice coil 12 is blocked off by the short-circuiting ring 16, whereby the harmonic distortion can be reduced, and at the same time an impedance in a high-frequency region can be counteracted thus maintaining sound pressure.

WORKING EXAMPLE

A dynamic cone speaker with a magnetic circuit shown in FIG. 1 was produced. The dynamic cone of the speaker has a diameter of 150 mm, and the short-circuiting ring is made of aluminum and has a length of 19 mm and a thickness of 2 mm, and the voice coil has an impedance of 4 Ω. The admittance curve (impedance curve) and sound pressure frequency characteristics of this speaker are shown in FIG. 3, and the characteristics of the total harmonic distortion (THD), second harmonic distortion and third harmonic distortion are shown in FIG. 5.

COMPARATIVE EXAMPLE

A dynamic cone speaker, which includes the same magnetic circuit as the working example speaker but excludes the short-circuiting ring, was produced. The admittance curve (impedance curve) and sound pressure frequency characteristics of the speaker are shown in FIG. 4, and the characteristics of the total harmonic distortion (THD), second harmonic distortion and third harmonic distortion are shown in FIG. 6.

Figure 3:
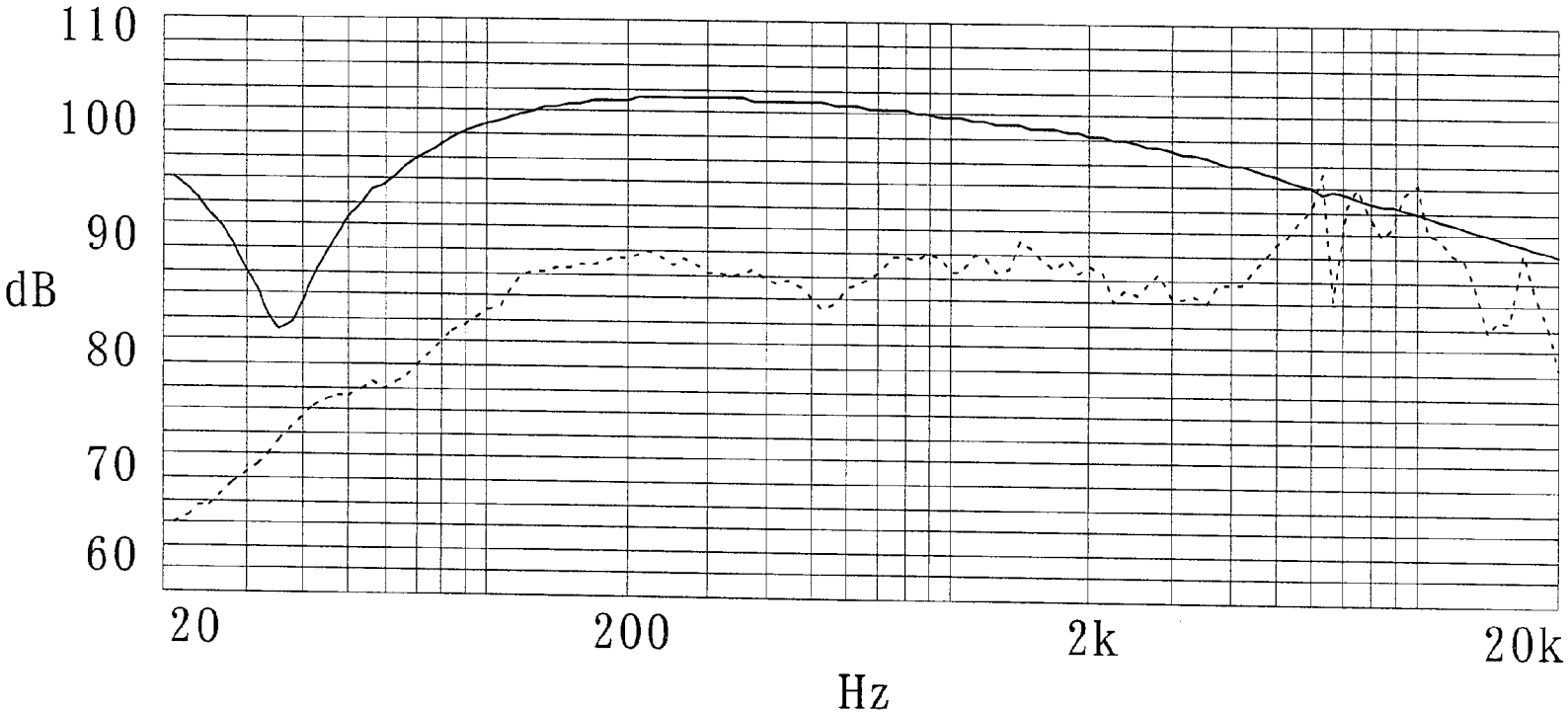
FIG. 3 is a graph of frequency characteristic data of a working example speaker.
Figure 4:
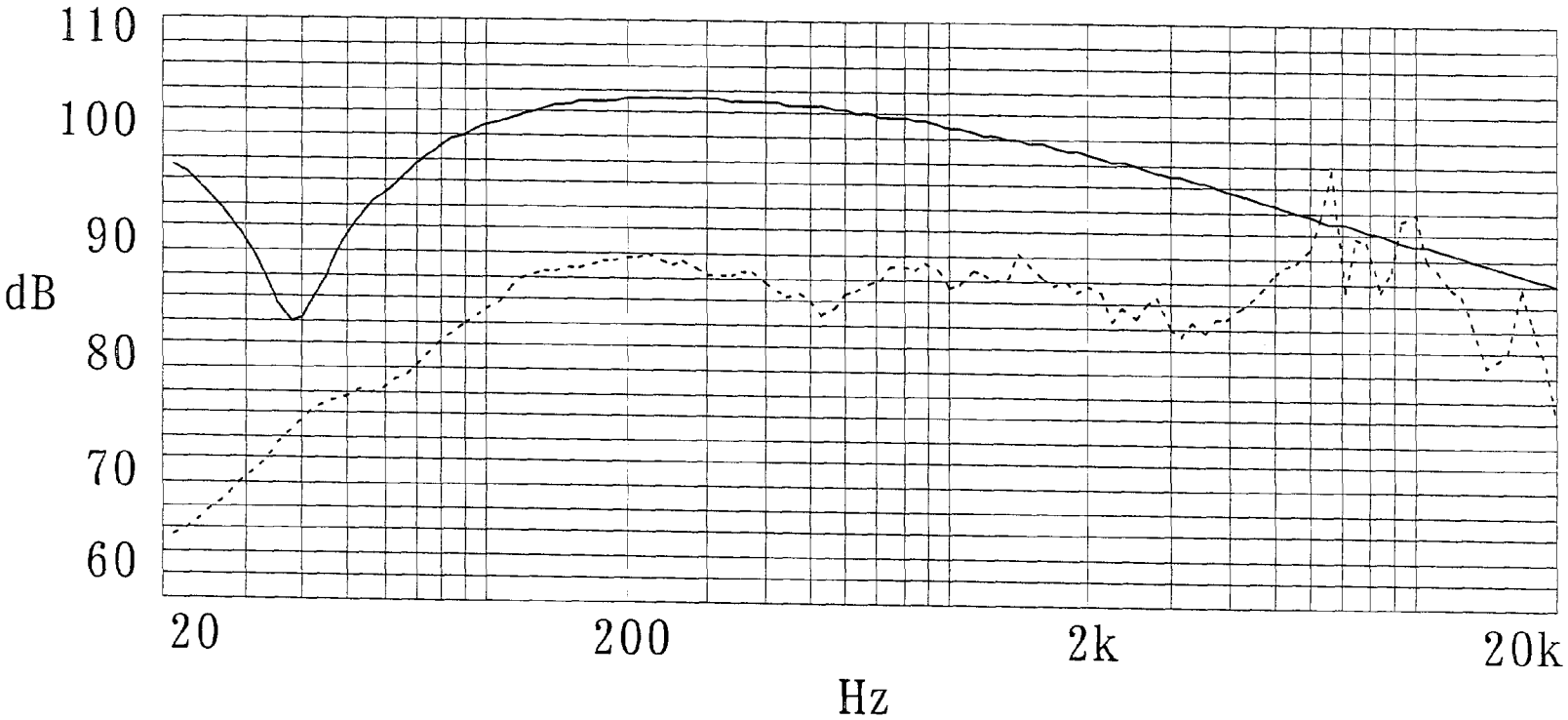
FIG. 4 is a graph of frequency characteristic data of a comparative example speaker.
Figure 5:
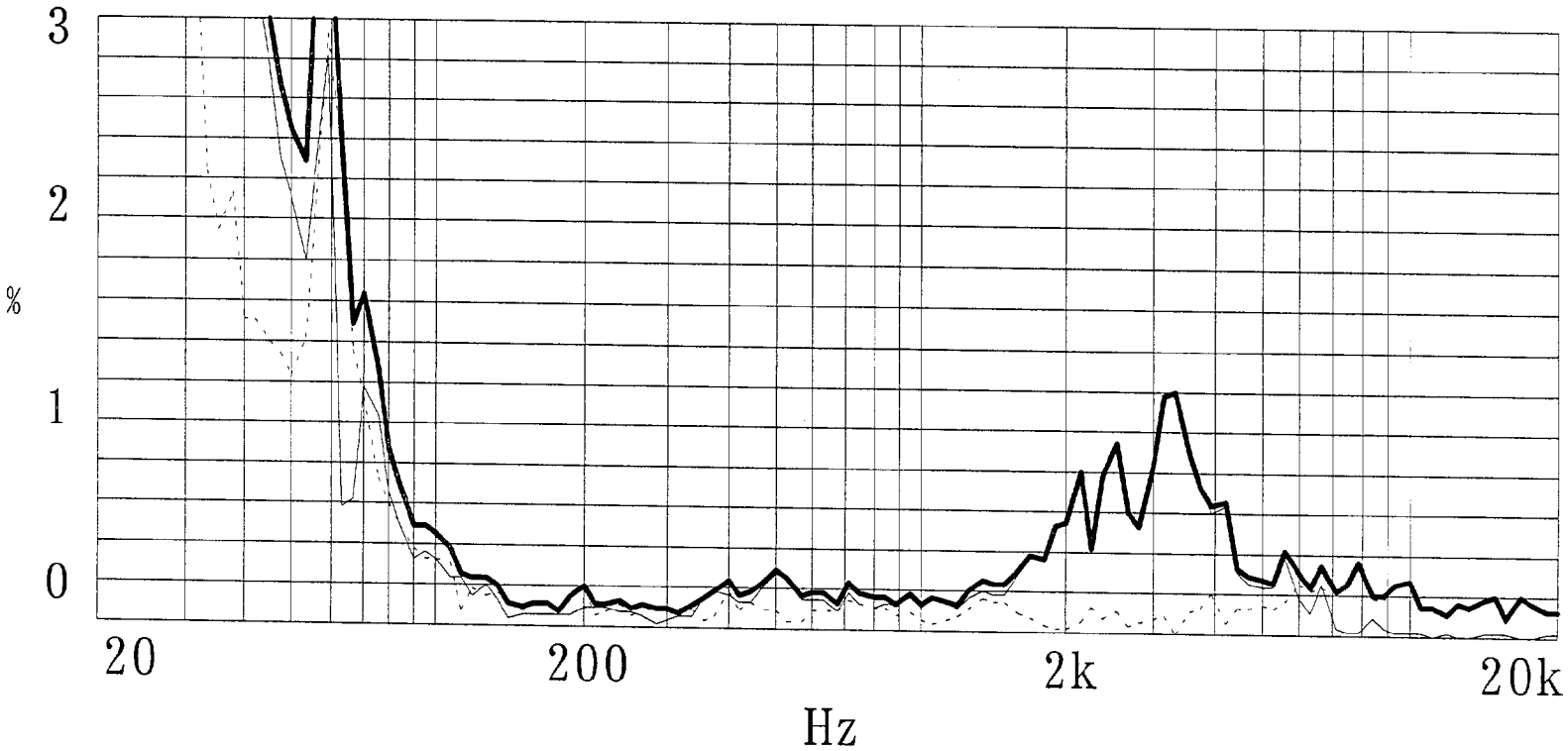
FIG. 5 is a graph of harmonic distortion characteristic data of the working example speaker.
Figure 6:
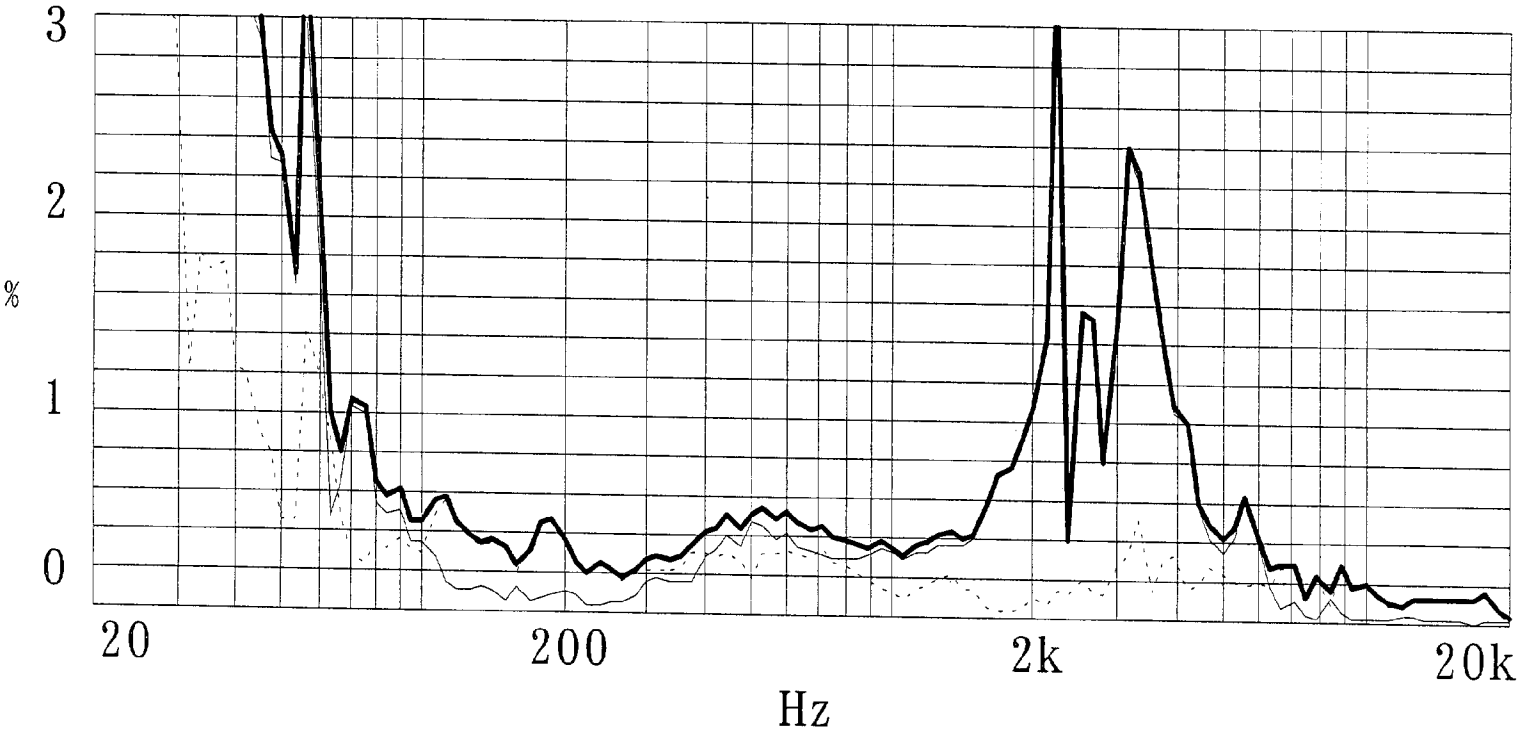
FIG. 6 is a graph of harmonic distortion characteristic data of the comparative example speaker.

In FIGS. 3 and 4, the solid line refers to admittance curve, and the dotted line refers to frequency characteristics, and in FIGS. 5 and 6, the heavy solid line refers to total harmonic distortion (THD), the dotted line refers to second harmonic distortion, and the thin solid line refers to third harmonic distortion.

Referring to FIGS. 3 and 4, from 1 kHz upward, the working example speaker shows a slower decline in admittance curve than the comparative example speaker. This is attributable to it that in the working example, the short-circuiting ring generates back electromotive force thereby canceling out the magnetic flux generated by the voice current and causing short-circuit, whereby resistance value is decreased resulting in maintaining sound pressure from 1 kHz upward.

Referring to FIGS. 5 and 6, in the working example speaker, since the short-circuiting ring blocks off an AC magnetic field generated by the voice coil, the second harmonic distortion, large part of which magnetic distortion accounts for, is reduced from 100 Hz upward, and at the same time the third harmonic distortion is reduced, whereby the total harmonic distortion (THD) is significantly reduced, compared with the comparative example speaker.

In the speaker 1 of FIG. 1, the height of the short-circuiting ring 16 is equal to the distance from the bottom face of the top plate 5 to the central portion of the top face of the bottom yoke 3 so as to block off an AC magnetic field covering an area larger than the excursion of the voice coil 12, but may alternatively be larger than the excursion of the voice coil 12.

When the short-circuiting ring 16 is fixed in the open space X of the magnetic circuit 7 with its upper and lower ends fitted into respective groves 16 and 16', the upper and lower ends may respectively be provided with a plurality of protrusions arranged at a prescribed interval and engage with the grooves by means of the protrusions.

What is claimed is:

1. A magnetic circuit for a speaker, the circuit comprising:

a bottom yoke having a center pole;

a ring magnet;

a top plate; and a short-circuiting ring having a cylindrical shape, the short-circuiting ring being disposed close and parallel to a voice coil and fitted into grooves located at an inner portion of a bottom face of the top plate and a cylindrical depression of the bottom yoke with an inner surface of the short-circuiting ring and an inner surface of the top plate lying in the same plane or substantially in the same plane.

2. The magnetic circuit for a speaker according to claim 1, wherein the short-circuiting ring has a height equal to or larger than an excursion of the voice coil.

3. The magnetic circuit for a speaker according to claim 1, wherein the short-circuiting ring is made of one of aluminum and copper.

4. A magnetic circuit for a speaker, the circuit comprising:

a bottom yoke having a center pole;

a ring magnet;

a top plate; and a short-circuiting ring having a cylindrical shape, the short-circuiting ring being disposed close and parallel to a voice coil and attached to an inner portion of a bottom face of the top plate with an inner surfaces of the short-circuiting ring and an inner surface of the top plate lying in the same plane or substantially in the same plane, wherein the short-circuiting ring fits into grooves located at the bottom face of the top plate and the top face of the bottom yoke.

* * * * *